US011053711B2

(12) United States Patent
Monaghan

(10) Patent No.: US 11,053,711 B2
(45) Date of Patent: Jul. 6, 2021

(54) DOOR LATCH INSTALLATION

(71) Applicant: Assa Abloy Limited, Willenhall (GB)

(72) Inventor: Daniel Monaghan, Ossett (GB)

(73) Assignee: Assa Abloy Limited, Willenhall (GB)

( * ) Notice: Subject to any disclaimer, the term of this patent is extended or adjusted under 35 U.S.C. 154(b) by 571 days.

(21) Appl. No.: 15/753,718

(22) PCT Filed: Aug. 19, 2016

(86) PCT No.: PCT/GB2016/052579
§ 371 (c)(1),
(2) Date: Feb. 20, 2018

(87) PCT Pub. No.: WO2017/029520
PCT Pub. Date: Feb. 23, 2017

(65) Prior Publication Data

US 2018/0238081 A1 Aug. 23, 2018

(30) Foreign Application Priority Data

Aug. 20, 2015 (GB) ..... 1514818

(51) Int. Cl.
*E05B 3/06* (2006.01)
*E05B 63/00* (2006.01)
(Continued)

(52) U.S. Cl.
CPC ..... *E05B 63/006* (2013.01); *E05B 9/084* (2013.01); *E05B 15/02* (2013.01); *E05B 63/10* (2013.01);
(Continued)

(58) Field of Classification Search
CPC ..... Y10T 292/06; Y10T 292/0977; Y10T 292/91; Y10T 292/82; Y10T 292/85; Y10T 292/858; E05B 63/006; E05B 63/0056
(Continued)

(56) References Cited

U.S. PATENT DOCUMENTS 1,661,454 A * 3/1928 Wilson ..... E05B 55/005 70/448
2,544,959 A * 3/1951 Hillgren ..... E05B 55/005 70/216
(Continued)

FOREIGN PATENT DOCUMENTS

DE 648571 C * 8/1937 ..... E05B 15/02
DE 102013106797 A1 * 12/2014 ..... E05B 63/0056
WO WO 9425709 * 11/1994

OTHER PUBLICATIONS

International Preliminary Report on Patentability, dated Feb. 20, 2018, from International Application No. PCT/GB2016/052579, 7 pages.
(Continued)

*Primary Examiner* — Carlos Lugo
(74) *Attorney, Agent, or Firm* — Michael A. Bondi; Moss & Barnett

(57) ABSTRACT

A door latch system (1) comprises a latch (10) and rose bases (60A,B) which clamp together against a door panel through a cross-drilling in the door panel by screws 80 engaging in bosses (94) above and below the latch body (12). The latch body is supported in the cross drilling by an adaptor (40) which in turn supports sleeve extensions (90) of the rose bases to prevent the rose bases from turning on operation of the handle knob/levers attached to the rose bases. The sleeve extensions are open, (that is, C-shaped in section) so that the diameter of the parts of the system within the cross drilling
(Continued)

can be minimised, whereby the diameter of the rose bases can likewise be kept within desirable limits of size.

6 Claims, 4 Drawing Sheets

(51) Int. Cl.

| | |
|---|---|
| ***E05B 63/10*** | (2006.01) |
| ***E05C 1/16*** | (2006.01) |
| ***E05B 15/02*** | (2006.01) |
| ***E05B 9/08*** | (2006.01) |
| *E05B 3/00* | (2006.01) |
| *E05B 27/00* | (2006.01) |

(52) U.S. Cl.
CPC ..... *E05C 1/163* (2013.01); *E05B 27/0003* (2013.01); *Y10T 292/06* (2015.04); *Y10T 292/82* (2015.04); *Y10T 292/91* (2015.04)

(58) Field of Classification Search
USPC ..... 70/150, 152, 153, 467–489
See application file for complete search history.

(56) References Cited

U.S. PATENT DOCUMENTS 2,723,874 A * 11/1955 Hillgren ..... E05C 1/163 292/336.3
2,811,384 A * 10/1957 Schmid ..... E05B 15/02 292/357
3,126,217 A * 3/1964 Russell ..... E05C 1/163 292/1
3,228,218 A * 1/1966 Wilson ..... E05B 55/005 70/475
4,037,865 A * 7/1977 Hook ..... E05B 3/06 292/357
4,428,212 A * 1/1984 Best ..... E05B 17/007 292/169.15
4,471,984 A * 9/1984 Bellantuono ..... E05B 3/04 292/350
4,564,229 A * 1/1986 Mullich ..... E05B 63/06 292/1.5
4,854,620 A 8/1989 Dunphy et al.
4,866,965 A * 9/1989 Urdal ..... E05B 13/004 70/481
4,877,278 A * 10/1989 Valley ..... E05B 3/06 292/350
4,974,883 A * 12/1990 Jans ..... E05B 9/002 292/169
5,125,696 A * 6/1992 Robida ..... E05B 3/065 292/169.16
5,236,235 A * 8/1993 Gustafson ..... E05B 9/082 292/357
5,368,345 A * 11/1994 Watts ..... E05B 55/005 292/1.5
5,411,303 A * 5/1995 To ..... E05B 3/06 292/357
5,769,472 A 6/1998 Small
5,816,086 A * 10/1998 Russell, IV ..... E05B 13/101 70/422
6,302,457 B1 * 10/2001 Shen ..... E05B 3/06 292/336.3
6,364,383 B1 * 4/2002 Shen ..... E05B 55/005 292/336.3
6,681,605 B1 * 1/2004 Huang ..... E05B 55/005 292/347
6,742,820 B2 * 6/2004 Shen ..... E05B 55/005 292/336.3
6,893,059 B2 * 5/2005 Shen ..... E05B 15/02 292/169
6,926,319 B2 * 8/2005 Bates ..... E05C 1/163 292/359
6,979,029 B2 * 12/2005 Shen ..... E05B 15/02 292/336.3
7,077,437 B2 * 7/2006 Huang ..... E05B 3/00 292/163
7,571,941 B2 * 8/2009 Chang ..... E05B 9/08 292/347
7,748,758 B2 * 7/2010 Fang ..... E05B 55/005 292/347
8,047,586 B2 * 11/2011 Pilotelli ..... E05B 63/006 292/357
8,182,005 B2 * 5/2012 Liu ..... E05B 55/005 292/347
8,235,431 B2 * 8/2012 Williamson ..... E05B 15/02 292/357
9,267,311 B2 * 2/2016 Huang ..... E05B 15/02
2004/0245788 A1 12/2004 Lin
2015/0069769 A1 * 3/2015 Chen ..... E05B 15/02 292/357

OTHER PUBLICATIONS

International Search Report and Written Opinion dated Nov. 4, 2016, from International Application No. PCT/GB2016/052579, 9 pages.

* cited by examiner

DOOR LATCH INSTALLATION

The present invention relates to a door latch installation for personnel doors for domestic or other applications.

BACKGROUND

Installation of door latches in the edges of door panels, and the associated handles on either side of the panel for operation of the latch, has evolved over time. A presently employed construction in some territories, for example in the United States of America, involves drilling an edge-hole in the edge of the door to receive a latch body, and a cross-drilling through the side of the door panel to intersect the edge-hole, on a centre line of the cross-drilling that is either 60 mm or 70 mm distance from the door edge at which the edge-hole opens. This distance (the backset) dictates the latch to be used, which latch has an operation aperture at one of these distances from a face plate of the latch, the face plate being intended to be flush with the door edge. The operation aperture is adapted to receive a handle spindle of a door handle, which is either in the form of a knob or a lever. Knob handles have handle spindles employing a large backset (57 mm, 70 mm or more), so as to give room for a user's hand to engage the handle without contact with a door jamb when the door is closed. Lever handles employ a latch with a small backset (45 mm or 57 mm), since the lever should not project near the centre of the door and the user's hand does not need to envelope the lever near the door jamb. Which back set is preferred is frequently a matter of choice.

In the United States, the diameter of the cross-drilling is typically 55 mm. The handles are secured to each other by cross screws that pass through the body of the latch. The cross screws (passing through the body of the latch) serve to further secure the position of the latch where its body is otherwise unsupported in the cross-drilling (although the latch is to some extent also supported by the handle spindle in the operation aperture of the latch). More importantly, however, they secure the position of the handles with respect to the door.

The handles each comprise a rose base in which is disposed the lever or knob with at least some degree of rotation ability with respect to the rose base, so that the lever/knob can rotate the handle spindle for operating the door latch. Usually, the knob or lever is spring-biased by a spring mounted in the rose base to return the knob or lever to a neutral position. This is generally horizontal with lever handles, but is not usually relevant with knob handles. Since the door latch is operated by turning the knob or handle, there is a corresponding rotational moment imposed on the rose base, so that if the latter is not well secured it can, over time, come loose and rotate also, leading to potential movement of the handle neutral position. The rose base must be larger (in diameter) than the diameter of the cross drilling, so that the edges of the facing rose bases on either side of the door panel can clamp the door panel when the cross screws are engaged between the two handles. The cross screws, on passing through apertures in the latch body, are retained by the latch body to prevent the rose bases from rotation.

It is an object of the present invention to provide an arrangement whereby a smaller diameter rose base may be employed.

SUMMARY OF THE INVENTION

In one aspect the present invention provides a door latch system for installation in a door panel having a crossingdrilling and an edge-hole intersecting the cross-drilling, the door latch system comprising:

a. a door latch having a face plate and a body, the body having a body axis and including an operation aperture at a desired backset from the face plate, the operation aperture being arranged for rotation in the body about an operation axis orthogonal to said body axis;

b. an adaptor to receive the door latch body;

c. two handles, each comprising a rose base and lever or knob rotatably disposed in the rose base; and d. a handle spindle having a longitudinal spindle axis, wherein:

the door latch system is adapted for installation in the door panel by:

i. the latch body being configured to be received in the edge-hole with the face plate substantially flush with the edge of the door;

ii. the adaptor being configured to fit with a close sliding fit in a door cross-drilling of between 40 and 50 mm, with a passage to receive the latch body so as to be support the latch body in the adaptor in the cross-drilling and so as to prevent rotation of the adaptor with respect to the latch body about said operation axis; and iii. the operation aperture and handle spindle being configured so that the handle spindle passes through the operation aperture, whereby said operation axis and spindle axis are coincident, and is received in each handle or knob, whereby rotation of the handle or knob results in rotation of the operation aperture about said axes and actuation of the latch, and wherein:

cross screws are provided to clamp the rose bases together, each rose base comprising screw holes disposed diametrically opposite one another on either side of said lever or knob, and so that said cross screws can be received through said cross-drilling around the latch body and through the adaptor, an extension sleeve of the rose bases around each screw hole supporting said cross screws and engaging the adaptor to locate the rose bases rotationally around said axes with respect to the adaptor, characterised in that said extension sleeves are C-shaped along their section whereby the diameter of the part of the handle to be received in the cross-drilling is defined by a boss centred on said screw holes into which said cross screws are adapted to be screwed.

A jig is frequently employed to cut two the edge-hole and intersecting cross-drilling in precisely the correct locations and a suitable jig is more fully described in our copending application filed contemporaneously herewith under the title "Door Latch Installation Jig" (and incorporated in its entirety by this reference thereto).

Thus, the extension sleeves support the cross screws and are parts of the rose bases so that the rose bases directly engage the adaptor. Engagement between the extension sleeve of the rose bases and the adaptor is optimally so close as to inhibit bending moments between the adaptor and extension sleeve in a direction of rotation of the rose base about said operation axis. The adaptor may have notches in its edge to receive said extension sleeves.

Given that the system must be designed to accommodate door panels of different thickness (doors are typically between 35 and 45 mm thick) the rose bases do not clamp against one another when the cross screws are tightened. Rather, they are pulled together against opposite sides of the door panel. That is adequate to resist tension on the rose bases but if there is rotation pressure on the rose bases, the screw heads in the screw holes can relatively easily deform the rose bases and are not well positioned to resist such rotation. However, the fixed extension sleeves are so well disposed and hence are desirable.

However, by rendering the extension sleeves C-shaped in section, they can, at the same time, be relatively large and on a relatively large diameter, and yet enable the internal parts of the handle system to fit into a 40 to 50 mm cross-drilling. Certainly in the United Kingdom and in other countries, rose bases on door handles tend to be no more than about 50 or 60 mm in diameter, and typically (but non-exhaustively) about 50 mm (many oblong rose bases can be less than 50 mm wide). To render the present arrangement useable in most situations, therefore, the diameter of a cross-drilling should be less 50 mm, say 45 mm. Thus if the contents of the latch system adapted to be within the cross drilling can be restricted to about 43 mm in diameter, this will fit in 44 mm cross-drillings, which can therefore accommodate the present system with all rose bases generally employed for door handles in the United Kingdom and many other countries.

In one embodiment, the screw holes of each rose base are adapted to receive the head of a screw which is freely rotatable in the screw holes and said boss is a separate sleeve, threaded from each end, to receive at each end one of said cross screws, said boss being received in a close sliding fit within each extension sleeve. Reception of the boss in each extension sleeve may be such a close sliding fit so as to inhibit bending moments between the boss and extension sleeve in a direction of rotation of the rose base about said operation axis.

This is the case for when the system is fitted to the thickest dimension of door for which the system is designed. At the same time, the extension sleeves and the boss are short enough not to contact one another when the system is fitted to the thinnest dimension of door for which the system is designed.

In another embodiment, the boss may be an integral part of one rose base and be integrated with the extension sleeve of said rose base. In that event, there is only one cross screw that is received in said integral boss/extension sleeve. Indeed, one rose base may have two integral boss/extension sleeves while the other has only screw holes for free retention of cross screws. Equally feasible, however, is each rose base having one integral boss/extension sleeve and one free screw hole, whereby the cross screw in the free screw hole of one rose base is arranged to be received in the integral boss/extension sleeve of the other rose base. The extension sleeve is present with the free screw hole.

In one embodiment, the screw holes are set to either side of a flange around a lever or knob reception bore of the rose base, said flange having a sufficiently large diameter that a cover plate with a corresponding central opening can be maneuvered around a lever after installation of the system in a door to cover heads of the cross screws.

In another embodiment, the latch body has a privacy button operable by a button on one rose base whereby the operation aperture may be rendered unrotatable by the handle or ineffective on rotation of the handle to operate the latch.

BRIEF DESCRIPTION OF THE DRAWINGS

Embodiments of the invention are further described hereinafter with reference to the accompanying drawings, in which.

DETAILED DESCRIPTION

Figure 1:
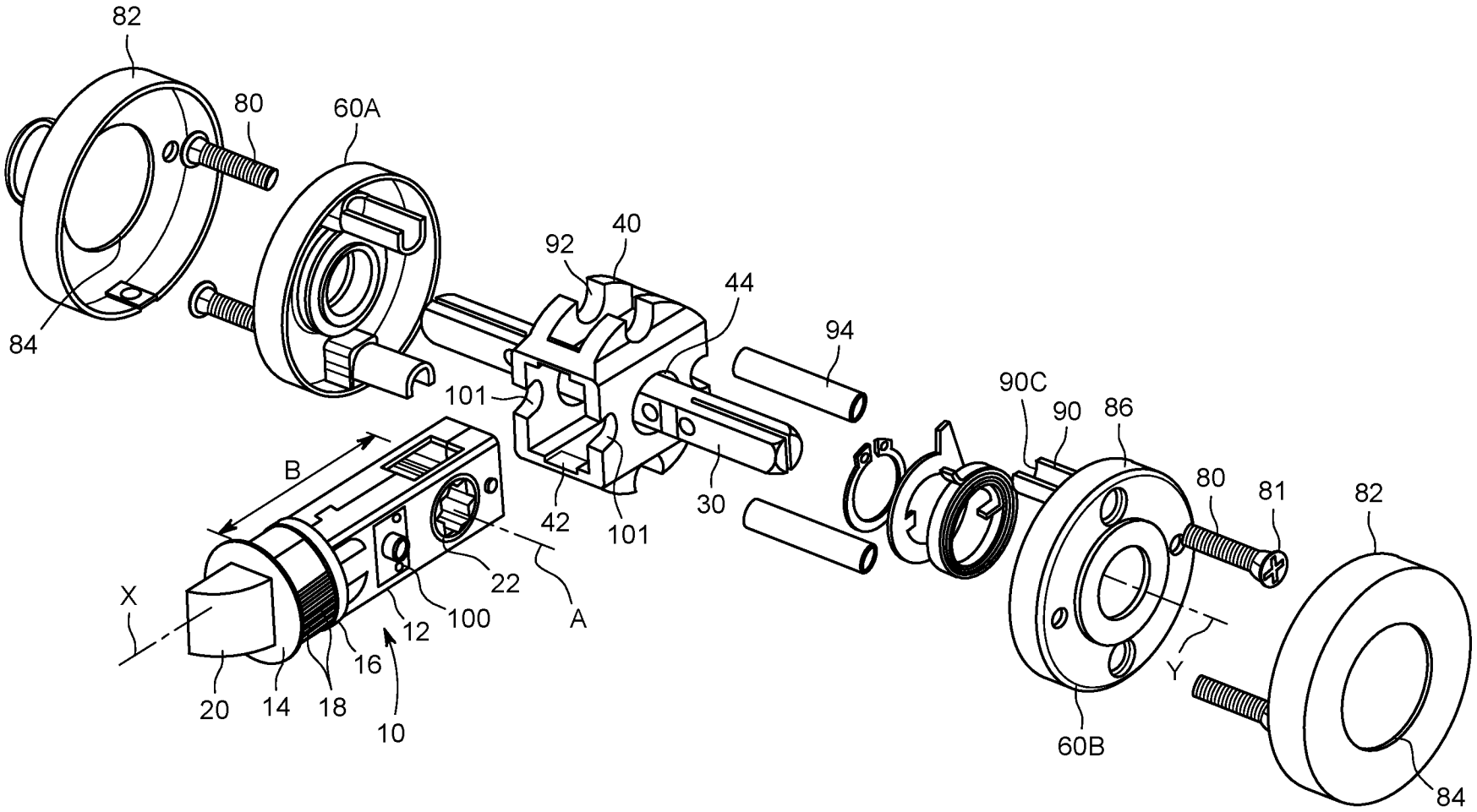
FIG. 1 is a perspective exploded view of a latch system in accordance with an aspect of the present invention.
Figure 2B:
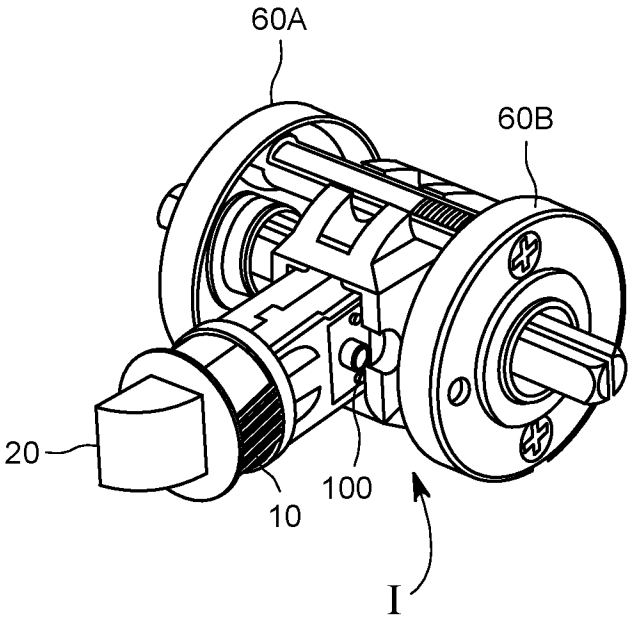
FIGS. 2*a* to *d* are respectively a plan view, perspective view, end view and side view of a latch system in accordance with an aspect of the present invention.
Figure 2A:
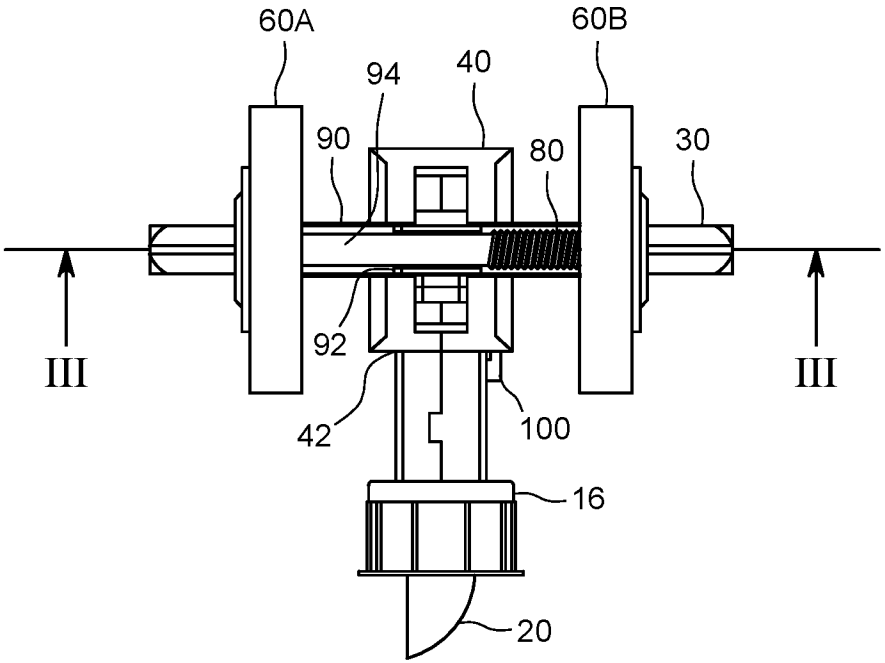
Figure 2D:
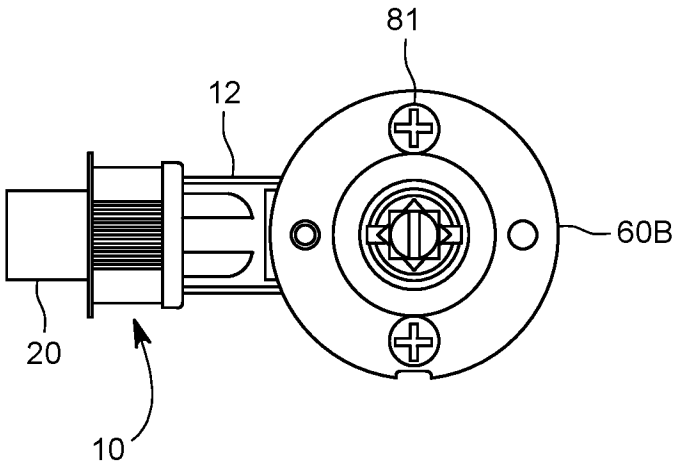
Figure 2C:
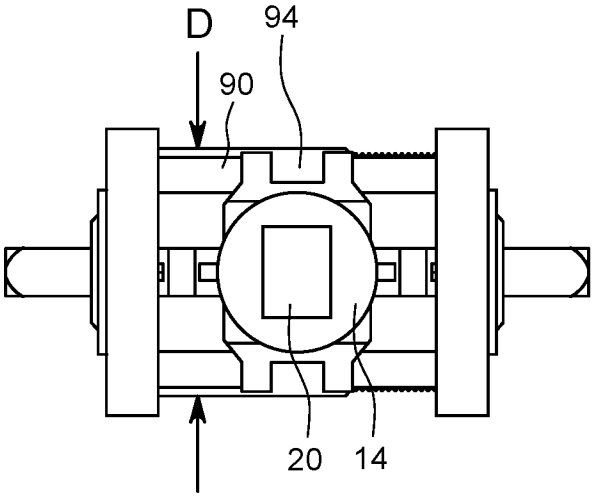

FIG. 1 shows a latch system 1 in accordance with one embodiment of the present invention. A latch 10 is known per se and comprises a latch body 12 and an end plate 14. The end plate 14 is round and has a cylindrical section 16 adapted to be received in an edge bore (not shown) in the edge of a door panel (also not shown). The section 16 has knurls 18 adapted to be a press fit in the edge bore if that is appropriately sized. Typically, the section 16 and the edge bore have a diameter of about 25 mm. The end of the latch 10 has the usual latch member 20, adapted to engage a keeper in a door jamb and retain the door closed in known fashion. The latch body 12 has a longitudinal axis X and an operation aperture 22, which is rotatable in the body about an operation axis A which is orthogonal the longitudinal axis X. The operation aperture 22 has a backset B, being the separation of the axis X from the end plate 14. This is typically either 45 mm or 57 mm, depending on the handle (not shown) to be employed with the door.

In a door with an edge bore, a cross drilling (not shown in FIG. 1 but shown at 50 in FIG. 3, in a door panel 52), is provided whereby the axis A of operation aperture 22 is arranged to be coincident with the cross-drilling. In the cross drilling 50, an adaptor 40 is first fitted in a close sliding fit in the cross drilling. It has a latch bore 42 arranged coincident with the latch axis X and with a cross section to receive the latch body (in this case substantially rectangular) when the latch is inserted in the edge bore. The adaptor also has a spindle hole 44 arranged coincident with the latch axis A. The bore 42 and the fitting of the adaptor in the cross drilling support the latch body in the cross-drilling, the support is against vertical movement and against rotation about the X axis. At the same time, the fitting of the latch in the edge bore supports the adaptor and prevents it from rotating about the A axis.

When the latch and adaptor are in place, the operation aperture 22 is adapted to receive in a sliding fit a square-section handle spindle 30, which has a longitudinal spindle axis Y, whereby, when assembled, operation axis A and spindle axis Y are coincident.

Two rose bases 60A,B are provided. As shown more clearly in FIG. 3 each rose base mounts a handle knob 62A or a handle lever 62B. The form of the handle lever or knob are incidental to the present invention and are shown only in dotted lines in FIG. 3, but, whatever their form, they are mounted for (at least limited) rotation in the rose base 60A,B, through a rotary joint 64 comprising a cylindrical stem and flange 66, washer 69 and circlip 70, passing through a circular aperture 74 in the rose base 60A,B. A spring 76, acting between the knob/lever flange/stem 66 and the rose base 60A, B, can be arranged to bias the knob/lever 62A,B to a stop position. The knob/lever 62A,B has a drive aperture 63A,B to receive the ends of the handle spindle 30. The handle spindle passes freely through the spindle hole and though the operation aperture 22, whereby turning of the knob/lever 62A,B results in rotation about the axis Y of the spindle and operation of the operation aperture 22 to withdraw into the latch body 12 the latch member 20.

The rose bases 60A,B each have screw holes 68 to receive two screws 80. The screw holes are diametrically opposed.

Their heads 81 are covered by a cap 82 having a central aperture 84. The central aperture needs to be as large as possible because it is intended to fit over the lever 62B. The cap may be screwed onto thread 86 on the rose base. The size of the aperture 84 needs to be large because it limits the design and shape of lever 62B that the latch system can accommodate, unless, that is, it is not required that the screw heads 81 be hidden, which, largely inevitably, must be left exposed where a knob 62A is employed as that will surely not pass through the aperture 84. As a result, the screws 80 need to be on as large a diameter as possible, and yet there is the restriction of the diameter of the cross drilling 50 if the rose base 60A,B is to cover the drilling completely.

In addition there is the requirement to restrain the rose bases from rotation under the effect of continual turning of the knob/lever 62A,B. For this, there are integral extension sleeves 90 that extend from the rose bases 60A,B around the screw holes 68 and are adapted to engage U-shaped slots 92 in the edges of the adaptor 40. The adaptor 40 is conveniently an injection-moulded plastics component. Internally, the extension sleeves are a close sliding fit over a boss 94 that is internally threaded at both ends and receives the screws 80. When they are tightened, the rose bases clamp the door panel around the cross-drilling 50. It is evident that the thickness T of the door panel is a variable parameter and the lengths of the sleeve extensions are such that and allowance L is provided so that the latch arrangement can accommodate door panels of thickness between (T−L) and T, which typically will be in the order of 35-45 mm. The similar dimension L is also left between the screws 80, with sufficient thread provided in the boss to accommodate the thickness variation. The upper limit T of the allowable door panel thickness is of course dictated by the overlap between the screws 80 and the boss 94. However, In FIG. 3, the boss 94 is screwed entirely onto the left-hand screw (in the drawing) and this does not leave more than a few turns of the thread for the right screw, or indeed much overlap between the boss and the right-hand extension sleeve 90. The arrangement could accommodate a wider door thickness, with as much overlap between the threads of the boss and right-hand screw, and between the right-hand extension sleeve and the boss, if the boss was not screwed tightly onto the left-hand screw. However, then, an important interengagement that does limit the door thickness, and is not improved by repositioning of the boss 94, is between the extension sleeves 90 and the adaptor slots 92. These desirably have a significant overlap so that there is less opportunity for lateral displacement between them.

Figure 3:
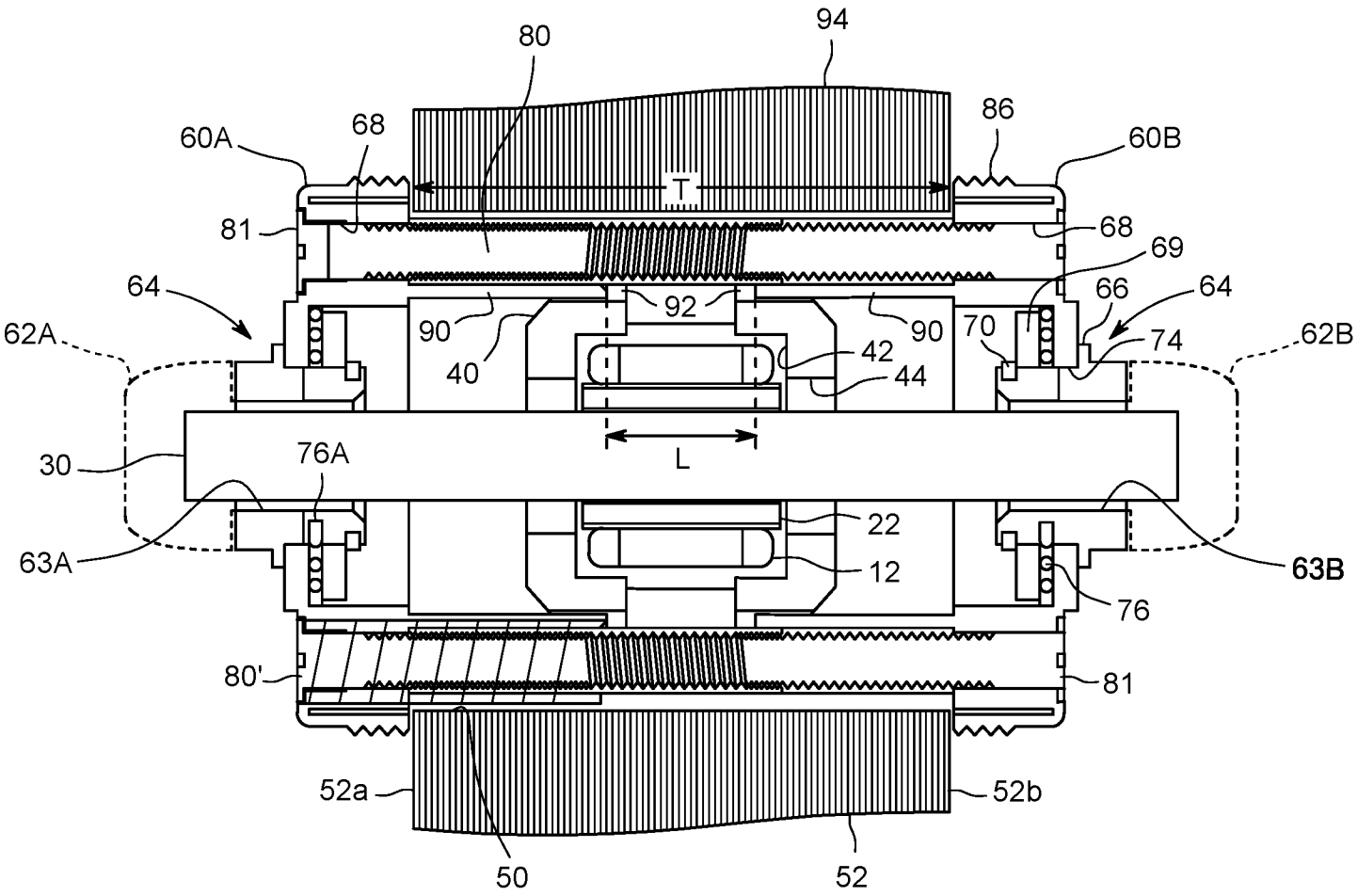
FIG. 3 is a section of the latch system shown in FIGS. 1 and 2, taken on the line III-III in FIG. 2*a*.

It is apparent that an alternative arrangement could be as shown roughly cross-hatched in FIG. 3 at 80', where the left-hand screw, sleeve extension and boss are all integrated as part of the rose base 60A. Indeed, both screws, sleeve extensions and bosses on one rose base 60A could be integrated so that, on that rose base, no cap 82 would be required, since no screw heads 81 would be evident. However, this would involve different rose bases 60A,B, which might be undesirable and that could be avoided by having each rose base have one screw, sleeve extension and boss integrated while the other side of the rose base is as currently shown in FIG. 3 (that is with screw hole 68, separate screw 80 and open sleeve extension 90.

Finally, given the desire to have the screws 80 on the maximum dimension possible, the extension sleeves 90 are C-shaped in section, with the open part 90C facing away from the axis Y, whereby the maximum diameter D of the internal parts of the latch system 1 (ie, those parts within the cross-drilling 50) is defined by the position of the screws 80 and the thickness of the boss 94. One reason why the boss 94 may be provided as a separate component (as shown in the drawings), and not be integrated with the rose base 60A, is so that it can be provided in a relatively hard steel, and thereby be rendered thin, whereas the material of the rose bases 60A,B may desirably be of softer less expensive material, such as aluminum or brass. In one embodiment, the dimension D is 43 mm, with the diameter of the cross drilling being 45 mm and the diameter (or minimum dimension) of the rose bases being 49 mm so that, with the cap 82 attached the final diameter is 50 mm.

One benefit of the arrangement whereby the screws 80 and accompanying components are disposed above and below the latch body 12 is that existing latches 10 can be employed. One arrangement has a privacy button 100 that can affect operation of the latch 10. It may be actuated by pressing or turning and serve either to lock the operation aperture 22 (so that the knob/lever 62A,B cannot be turned) or to render its rotation disconnected from the latch member 20 so that that remains in the closed position despite turning of the knob/lever 62A,B. Where the privacy button is to be employed, one rose base 60A,B is provided with an actuator (not shown) to actuate the button 100. This is disposed at right angles (around axis Y) in the rose base and a slot 101 is provided in the adaptor to accommodate it.

Any of the above-described features can be used in any suitable combination with any of the other above-described features, and the present invention is not necessarily limited to the specifically described combinations.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

The invention claimed is:

1. A door latch system for installation in a door panel having a cross-drilling and an edge-hole intersecting the cross-drilling, the door latch system comprising:

a. a door latch having a face plate and a body, the body having a body axis and including an operation aperture at a desired backset from the face plate, the operation aperture being arranged for rotation in the body about an operation axis orthogonal to said body axis;

b. an adaptor to receive the door latch body;

c. two handles, each comprising a rose base and lever or knob rotatably disposed in the rose base; and d. a handle spindle having a longitudinal axis, wherein the door latch system is adapted for installation in the door panel by:

i) the latch body being configured to be received in the edge-hole with the face plate substantially flush with the edge of the door;

ii) the adaptor being configured to fit with a close sliding fit in a door cross-drilling of between 40 and 50 mm, with a passage to receive the latch body so as to support the latch body in the adaptor in the cross-drilling and so as to prevent rotation of the adaptor with respect to the latch body about said operation axis; and iii) the operation aperture and handle spindle being configured so that the handle spindle passes through the operation aperture, whereby said operation axis and longitudinal axis are coincident, and is received in each handle or knob, whereby rotation of the handle or knob results in rotation of the operation aperture about said axes and actuation of the latch, and wherein:

cross screws and bosses are provided to clamp the rose bases together, the bosses comprising a sleeve threaded from each end for receiving said cross-screws, each rose base comprising screw holes disposed diametrically opposite one another on either side of said lever or knob, so that said cross screws can be received in the cross-drilling around the latch body, and an extension sleeve formed around each screw hole, the extension sleeves being configured for supporting the bosses when the cross screws are received in the bosses and engaging the adaptor to locate the rose bases rotationally around said axes with respect to the adaptor, wherein said extension sleeves are C-shaped along their section, with an open part facing away from said axes such that a maximum diameter of the part of the handle to be received in the cross-drilling is defined by a boss located in a C-shaped section of an extension sleeve.

2. A door latch system as claimed in claim 1, wherein reception of the boss in each extension sleeve is a close sliding fit to inhibit bending moments between the boss and extension sleeve in a direction of rotation of the rose base about said operation axis.

3. A door latch system as claimed in claim 1, wherein the screw holes are set to either side of a flange around a lever or knob reception bore of the rose base, said flange having a sufficiently large diameter that a cover cap with a corresponding central opening can be manoeuvred around a lever after installation of the system in a door to cover heads of the cross screws.

4. A door latch system as claimed in claim 1, wherein engagement between the extension sleeve of the rose bases and the adaptor is so close to inhibit bending moments between the adaptor and extension sleeve in a direction of rotation of the rose base about said operation axis.

5. A door latch system as claimed in claim 4, wherein the adaptor has notches in its edge to receive said extension sleeves.

6. A door latch system as claimed in claim 1, wherein the latch body has a privacy button operable by a button on one rose base whereby the operation aperture may be rendered unrotatable by the handle or ineffective on rotation of the handle to operate the latch.

* * * * *